United States Patent [19]

Casad

[11] Patent Number: 5,022,878

[45] Date of Patent: Jun. 11, 1991

[54] WET SUIT STYLE PERSONAL FLOTATION DEVICE

[75] Inventor: Thomas R. Casad, Celina, Ohio

[73] Assignee: Casad Manufacturing Corp., St. Marys, Ohio

[21] Appl. No.: 240,752

[22] Filed: Sep. 2, 1988

[51] Int. Cl.[5] ..... B63C 9/093

[52] U.S. Cl. ..... 441/103; 2/2.1 R; 441/107

[58] Field of Search ..... 441/102–105, 441/106, 107, 114–116; 2/2.1 R

[56] References Cited

U.S. PATENT DOCUMENTS

| | | | |
|---|---|---|---|
| D. 292,015 | 9/1987 | McWaters | D21/238 |
| 2,911,649 | 11/1959 | Ruelle et al. | 441/104 X |
| 2,981,954 | 5/1961 | Garbellano | 2/2.1 R |
| 3,076,206 | 2/1963 | Shaw et al. | 441/104 |
| 3,246,621 | 4/1966 | Copeland | 2/2.1 R |
| 3,686,064 | 8/1972 | Bonnet et al. | 2/2.1 R |
| 4,047,255 | 9/1977 | Kiefer | 441/106 |
| 4,689,030 | 8/1987 | McWaters | 441/88 |

OTHER PUBLICATIONS

Wet Vest advertisement in Running Times, Nov., 1988, p. 47.

HO sales literature.

Wavelength advertisement, Water Ski magazine, 1989 Boat Buyers Guide, special edition (mailed Aug. 1989).

*Primary Examiner*—Sherman Basinger

*Attorney, Agent, or Firm*—Emch, Schaffer, Schaub & Porcello Co.

[57] ABSTRACT

A wet suit style personal flotation device is disclosed which comprises a wet suit adapted for fitting about at least a portion of a wearer and substantially conforming to at least the wearer's torso and a buoyant insert interposed between an outer layer and an inner layer of a vest portion of the wet suit. The buoyant insert extends in front of and behind the wearer's body. The wet suit style personal flotation device is constructed such that the wearer is supported in a slightly back from vertical position in water and such that the wearer can don the suit in less than about 60 seconds.

12 Claims, 6 Drawing Sheets

SEE FIG. 3
SEE FIG 12

SEE FIG. 5
10
20
21
30
31
32
33
34
40
5a
5b

WET SUIT STYLE PERSONAL FLOTATION DEVICE

BACKGROUND OF THE INVENTION

The present invention relates to a wet suit style personal flotation device which is especially useful for those enthusiasts participating in water sports such as water skiing, sail boarding, knee boarding, jet skiing, barefooting, and boating.

There are many different types of personal flotation devices currently in use by water sport enthusiasts. In particular, a personal flotation device such as a Coast Guard Type III life vest is popular. These life vests are designed for use in calm inland waters where there is a good chance of fast rescue. As such, the performance along with the comfort and wearability of the personal flotation device is important.

In order to be an effective Type III U.S. Coast Guard approved personal flotation device the device must be able to keep a conscious person face up in the water with his mouth at least two inches above water, on average such that the person's respiration is not impeded. Thus, the wearer must be held in an upright or slightly backward position. According to Coast Guard regulations, the wearers must be held at a minimum of 7° back from vertical up to 80° back from vertical. Once a wearer has assumed an upright or vertical or tilted slightly backward position in the water, the personal flotation device must allow the wearer to at least maintain that position. The personal flotation device must show no tendancy to tip the wearer face down in the water.

In addition, the wearability of the personal flotation device is affected by the buoyancy of the personal flotation device. Typically, the buoyant material of the personal flotation device is distributed along the front and back of the wearer for ease of wear and movement. However, the maximum buoyancy of the device which can be achieved is often reduced by the manufacturer in order to achieve a lighter weight and less bulky personal flotation device.

The physique of the wearer greatly affects the personal flotation device's performance. Often the personal flotation devices are manufactured so as to fit a range of sizes of wearers. As such, there may be a sloppy or loose fit of the buoyant device on the wearer. The personal flotation device tends to ride up on the body of the wearer. As the flotation device rises on the body of the wearer, the wearer sinks, a factor which greatly effects the breathing margin when the wearer's mouth must be at least 2 inches above water, on the average.

Further, a wearer's physique determines how that wearer will float, due to the fact that muscle and bone are heavier than water while fatty tissue is lighter, and as such, heavy-boned and muscular people tend to sink in the water while lighter-boned and overweight people tend to float. Also the distribution of fat and muscle determines whether the wearer tends to float vertically or horizontally. It is therefore important than the personal flotation device performs adequately by tilting the wearer backwards slightly from vertical. However, some of the personal flotation devices currently in use may not hold the face of an unconscious wearer out of the water, and in rough seas a wearer's face may be covered by the waves. The personal flotation devices which do tilt the person backwards almost to a horizontal position to allow the wearer to breathe and keep afloat even if the wearer becomes exhausted and helpless. However, most wearers of personal flotation devices participating in water sports will not likely be conscious and reasonably mobile after falling into the water. In addition, most wearers may wish to remain vertical in order to look around easily and wave for help.

Another factor in considering the performance of personal flotation devices is the fact that hypothermia, the loss of body heat is a major cause in boating injuries and deaths in cold water. In fact, one of the leading causes of death while wearing a U.S. Coast Guard approved Type III personal flotation device is hypothermia. After an hour in 50° F. water, most people would lose consciousness. Therefore, most water sport enthusiasts, when participating in sports in relatively cold water and not adequately protected by wearing the currently available life vest or jacket. Therefore, it is necessary for such enthusiasts to seek added protection by wearing a wet suit under the life vest or jacket.

Various types of wet suits are available for use in on-the-water and underwater sports. Wet suits are typically rubber-like protective clothing constructed to provide warmth and protection. A wet suit traps a thin layer of water between the wet suit and the wearer's body creating a thermal layer of warmth not provided to the wearer of only a vest or jacket type personal flotation device. Wet suits are often made using the rubber-like material neoprene. The neoprene material has elastomeric properties thus allowing the wet suit to stretch and provide the wearer with a snug fit. The snug fit not only provides the wearer with ease of movement in and on the water, but also effectively retains body heat within the wet suit. One drawback to the use of wet suits, however, is that despite the flexibility of the suit, the donning and removing of the wet suit is generally a somewhat time consuming and cumbersome ordeal.

Still, these wet suits are often used by water skiing enthusiasts to protect the water sport enthusiast from dangers associated with high speed impacts upon falls in the water and to prevent loss of essential body heat when in cold waters. Such water sport enthusiasts thus also wear a protective life vest or jacket over the wet suit. However, there are various drawbacks associated with this type of usage since the vests or jackets must be laced, strapped, or zipped onto the wearer in order to provide a snug fit over the wet suit and to keep the vest or jacket from riding up on the shoulders of the wearer. Further, when participating in high speed water sports, the life vest or jacket can be torn from the wearer's body when the wearer hits the water at a high speed. In order to lessen the impact of hitting the water at a high speeds of, for example, 50 miles per hour, various wet suit manufacturers have added cushioning or padding material to the wet suits. Such padding material, when useful in protecting the wearer from impact-type injuries, does not provide the wearer with adequate personal flotation safety. Rather, these padded suits are designed primarily for protection to a wearer for water skiing competitions such as jumping and barefooting. As such, the primary concern of the padded suit manufacturers is providing a suit having a desired flexibility which also provides impact-injury protection and warmth. The padded suits are not intended to keep a person afloat and such suits fail to meet the U.S. Coast Guard requirements for personal flotation devices. In fact, many padded suit manufacturers print in bold letters on the inside of the padded wet suit that the padded suit is not a substitute for a personal flotation device.

Furthermore, it is still a cumbersome practice to wear a life vest or jacket over a wet suit, especially when the wearer performing difficult or risky water sport stunts such as jumping and free-style water skiing.

Thus, there is need for a wet suit style personal flotation device without the above-mentioned drawbacks which personal flotation device offers satisfactory performance as a flotation aid along with comfort and wearability to the wearer. The wet suit style personal flotation device of the present invention is directed to meet these needs, as will be readily understood by referring to the specification, drawings and claims disclosed herein.

SUMMARY OF THE INVENTION

The present invention provides a wet suit style flotation device which has the buoyancy, durability and longevity properties needed to be classified as a United States Coast Guard approved Type III personal flotation device.

In accordance with the present invention there is provided a wet suit adapted for fitting about the torso of a wearer and comprising a vest having an inner layer and an outer layer and a buoyant insert interposed between the inner and outer layers. The wet suit personal flotation device is constructed so as to support the wearer in a minimum of 7 degrees back from the vertical position in water such that the wearer's respiration is not impeded. The wearer can don the wet suit style personal flotation device in less than about 60 seconds.

DESCRIPTION OF THE INVENTION

Figures 1, 2, 3, 3A, 3B:
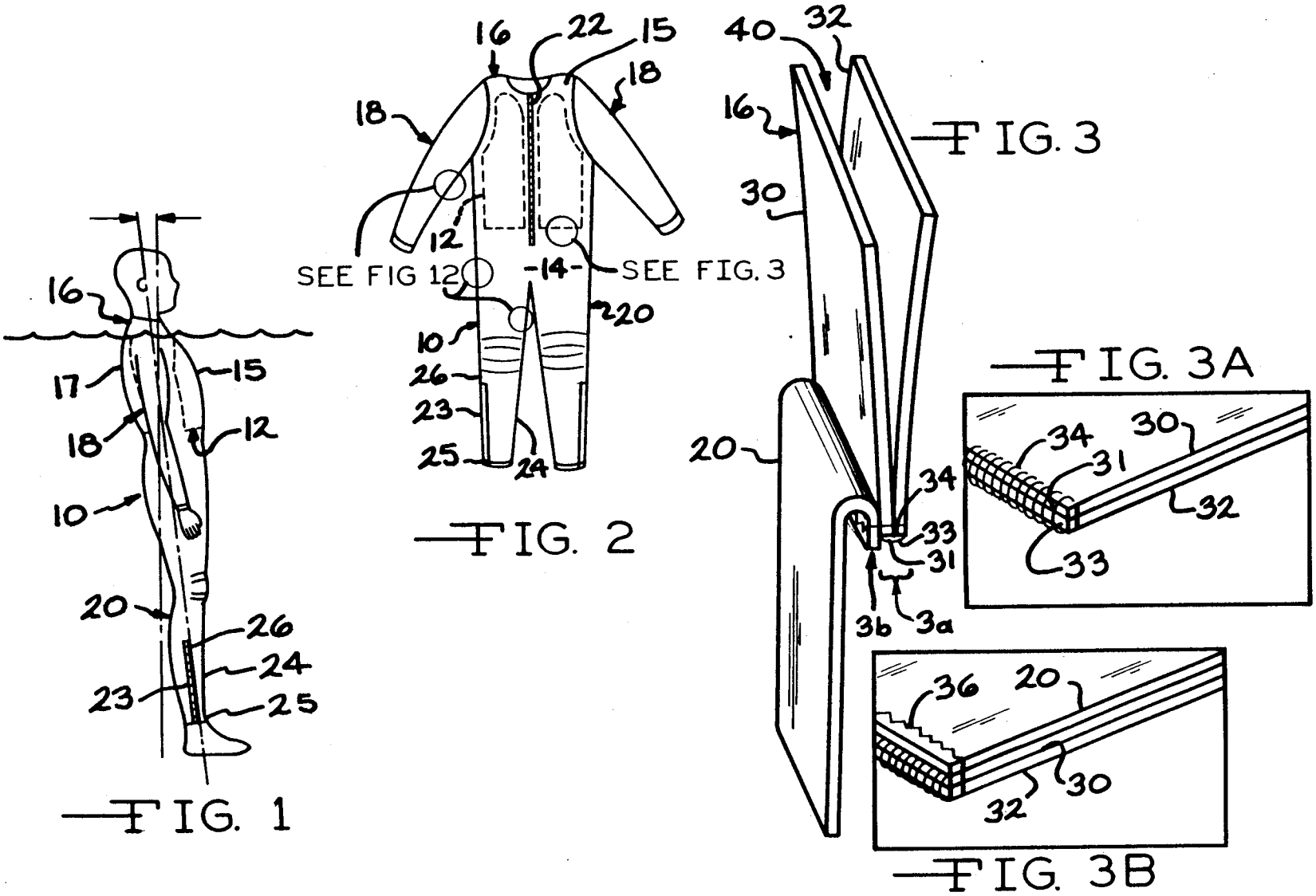
FIG. 1 is a diagrammatic, side elevational view, partially in phantom, of a person wearing a wet suit style personal flotation device.
FIG. 2 is a front elevational view, partially in phantom, of a wet suit style personal flotation device.
FIG. 3 is a fragmentary, perspective view showing one embodiment of a construction of the wet suit style personal flotation device.
FIG. 3A is a fragmentary, perspective view taken generally in the direction of arrow 3*a* in FIG. 3.
FIG. 3B is a fragmentary, perspective view taken generally in the direction of arrow 3*b* in FIG. 3.

Referring now to FIG. 1, a person is shown in a diagrammatic side elevational view wearing one embodiment of a wet suit style personal flotation device of the present invention.

The wet suit style personal flotation device of the present invention will hold the wearer a minimum of 7 degrees back from vertical. Once a wearer has assumed a vertical position in the water, the wet suit style personal flotation device of the present invention will put the wearer at a minimum of 7 degrees back from vertical position. From this slightly back position, the present invention is able to keep a conscious person face up in the water with his mouth at least two inches above water, on the average. The personal flotation device of the present invention shows no tendancy to tip the persons face down into the water.

In addition, the personal flotation device of the present invention meets the U.S. Coast Guard standards for a Type III approved personal flotation device such that a wide range of sizes and types of wearers can don the personal flotation device of the present invention quickly in less than one minute, with clothes and shoes on. The wet suit style personal flotation device of the present invention protects a wearer from impact speeds with water up to at least about 50 mph.

The wet suit style personal flotation device 10 generally includes an insert 12 which is a quantity of foam buoyant material which has been cut or formed for insertion into, or enclosed within, at least a portion of, a garment or suit 14. The suit 14 is constructed of a flexible protective material such as, for example a neoprene material. Both the foam buoyant material of the insert 12 and the neoprene flexible protective material of the suit 14 meet such rigid standards as buoyancy, durability, longevity, fire retardancy, flexiblity and shear strength. The wet suit style personal flotation device of the present invention has a construction such that the type, amount and location of the foam byoyancy material and neoprene flexible protective material allow the present invention to be classified by the U.S. Coast Guard as a Type III personal flotation device.

The present invention is applicable to all styles of wet suits. Preferred embodiments of the wet suit style personal flotation device 10 of the invention are sized to meet a range of wearer sizes and body types, for example, toddler, child, youth, small, medium, large, extra large or extra extra large. The style generally known as a full wet suit, having a main torso portion and full length sleeves and pants is generally shown in the drawings.

The wet suit personal flotation device 10 is adapted for fitting about and substantially conforming to at least the torso of the wearer. In the embodiments shown in the drawings the wet suit style personal flotation device 10 generally includes a vest 16 encapsulating the insert 12 and generally covering the torso of the wearer and having a front portion 15 and a back portion 17, sleeves 18 and pants 20. However, it is within the contemplated scope of the present invention that the wet suit style personal flotation device 10 comprises a vest 16 encapsulating the insert 12 or, alternatively, the wet suit style personal flotation device 10 can be sleeveless or can have short sleeves and/or short legs (not shown). It is also within the contemplated scope of the present invention that the personal flotation device 10 includes protective padding material (not shown) in the seat of the pants for added protection to the water sport enthusiast. If desired, buckles and leg straps (not shown) can be used on, for example, the short pant leg wet suit styles and can be used to help keep water out of the wet suit.

Referring again to FIGS. 1 and 2, the wet suit style personal flotation device 10 further includes a fastening mechanism 22 extending along a generally median centerline of the front portion 15 of the vest 16. It is within the contemplated scope of the present invention that various configurations of fastening mechanisms used to secure the wet suit style personal flotation device to the wearing, including, but not limited to, extending vertically or at a diagonal across the chest, extending along either side or down the back. In the embodiment shown, the fastening mechanism 22 is generally indicated as a zipper, as can be best seen in FIG. 10. However, it is within the contemplated scope of the present invention that the vest 16 can be fastened together with snaps, laces, buckles, self-adhering hook and pile fastener material such as Velcro® material, webbing or straps or the like. It is further within the contemplated scope of the present invention that the pants and/or sleeves be detachable from the vest 16 (not shown), using, for example zippers, snaps, laces, buckles, or self-adhering hook and pile materials such that the wearer can, at his option, add or remove the sleeves and/or pants or a portion or the pants (not shown).

In the full wet suit style personal flotation device shown in the drawings, the pants 20 include a fastening mechanism 23, generally extending along a median centerline of the outer calf portion of each leg 24 of the pants 20. In preferred embodiments the fastening mechanism 23, here generally shown as a zipper but which can be any of the above described fastening mechanisms, extends from the cuff portion 25 near the wearer's ankle to a point generally mid-calf 26 or higher such that the length of the opening (not shown) defined by the fastening mechanism 23 on each leg 24 of the pants 20 allows the wearer to don the suit with ease and to don the suit within the U.S. Coast Guard requirements of less than one minute.

In preferred embodiments of the present invention, the foam buoyant material 12 meets rigid standards as set forth by the U.S. Coast Guard, is comprised of a closed-cell foamed polymeric material such as a polyvinylchloride (PVC) foam or ethylene vinyl acetate (EVA) foam. It is also within the contemplated scope of the present invention that any foam buoyant material which will provide a minimum of buoyancy of at least 15½ pounds force can be used. The flexible protective material of the suit is preferably made of a material such as neoprene, which is an oil-resistant synthetic rubber and meets rigid standards as set forth by the U.S. Coast Guard. In preferred embodiments the flexible protective material has a desired thickness of 1 to 3 mm. It is also contemplated that the flexible protective material of the vest can have a thickness of, for example, 1 mm while the remaining portions of the flexible protective material of the wet suit style personal flotation device have a greater thickness such that the relatively thinner vest allows the wearer greater comfort and ease of movement, while the relatively thicker remaining portions of the wet suit style personal location device still provide the wearer with warmth. If desired, the protective material can be coated on both the inside and outside with a nylon material, such as the neoprene-type material available from the Rugbatex Corporation.

The wet suit style personal flotation device 10 of the present invention has a buoyancy tolerance which ranges from at least about 15½ pounds up to at least about 19 pounds. According to the present invention, the wet suit style personal flotation device has a front buoyancy distribution tolerance ranging from approximately 50% to approximately 70%; that is, the foam buoyant material and the flexible protective material both contribute to the buoyancy of the personal flotation device such that the wearer is held in an almost vertical position or at approximately 7° backwards from vertical. According to one preferred embodiment of the invention, the wet suit style personal flotation device has a front buoyancy distribution tolerance range from approximately 57% to approximately 63%. The front buoyancy distribution is preferably more than 50% in the front portion 15 of the vest 16 in order to keep the wearer's face out of the water.

The general construction of the suit 14 can be accomplished using conventional fabrication techniques wherein the flexible protective neoprene material, as described above, is cut in accordance with predetermined patterns according to the desired size ranges and suit configurations desired. The cut flexible protective neoprene material is then fabricated into the suit 14.

Figure 9A:
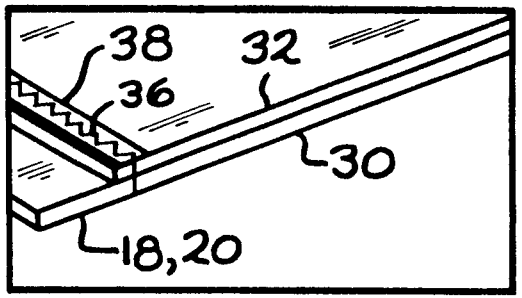
FIG. 9A is a fragmentary, perspective view taken generally in the direction of arrow 9*a* in FIG. 9.

FIG. 3 shows one embodiment of the construction of the wet suit style personal flotation device 10 of the present invention. In this embodiment, the vest 16 comprises an outer layer 30 and an inner layer 32. The outer layer 30 and inner layer 32 are sewn together as shown in FIG. 3A wherein a serge type stitch 34 is shown. It is also within the contemplated scope of the present invention that the seams of the wet suit style personal flotation device of the present invention can have any suitable locking stitch seam construction for the structural seams of the wet suit style personal flotation device. The structural seams are seams which serve a functional purpose is the wet suit style personal flotation device as distinguished from a decorative function. The locking stitches used in the present invention meet the U.S. Coast Guard standards of a minimum of 70 lbs. seam tear strength. A locking stitch is a stitch that will not unravel when a force is applied in the direction of the seam on any of the threads forming the stitch. Other types of locking stitching can be used for the seam construction such as a blind stitch, zigzag stitch or a Mauser joint (as can be seen by referring to FIGS. 9 and 9A), or any suitable combination thereof. The Mauser joint entails butting together the edges of the layers to be seamed together and applying an elastic tape along the joint which tape is stitched into the material. Thus, for the embodiments shown, it should be understood that while the serge stitch is shown, other suitable seam constructions can also readily be used. In one embodiment the outer and inner layers, 30 and 32, respectively, are sewn together using between about 8 +/−2 to about 14 +/−2 inch per stitch. A leading edge 31 of the outer layer 30 is placed in alignment with (or butted together with) a leading edge 33 of the inner layer 32 and sewn together. Thereafter, the seamed together leading edges 31 and 33 are placed in a spaced apart relationship to a leading edge 21 of the pants 20 and sewn together with, for example, a zigzag stitch 38, as seen in FIG. 3B. In one embodiment, where the protective flexible material of the suit 14 is approximately 3 mm thick, there are about 14 +/−2 stitches per inch, and where the protective flexible material of the suit 14 is approximately 2 mm thick, there are about 12 +/−2 stitches per inch. The types of thread material which are especially useful with the present invention include, for example, a polyester and vinyl type material such as Style V-69 supplied by the Hemmingway and Barlett Manufacturing Company or a filament polyester or a spun polyester type thread such as those designated as 69 BST twistalon filament polyester and 20/3 Sewkay plus T-105 spun polyester thread available from the Threads USA Company.

During the construction of the embodiment shown in FIG. 3 of the wet suit style personal flotation device 10, the vest 16 and pants 20 are seamed together in a suitable manner to form a pocket, generally indicated as 40, for receiving the foam buoyant material of the insert 12. After placement of the insert 12 into the pocket 40 formed by the inner layer 30 and outer layer 32 of the vest 16, the remainder of the wet suit style personal flotation device 10 is constructed such that the insert 12 is enclosed within the pocket 40, as can be seen by generally referring to FIG. 1.

Figures 4, 5, 5A, 5B:
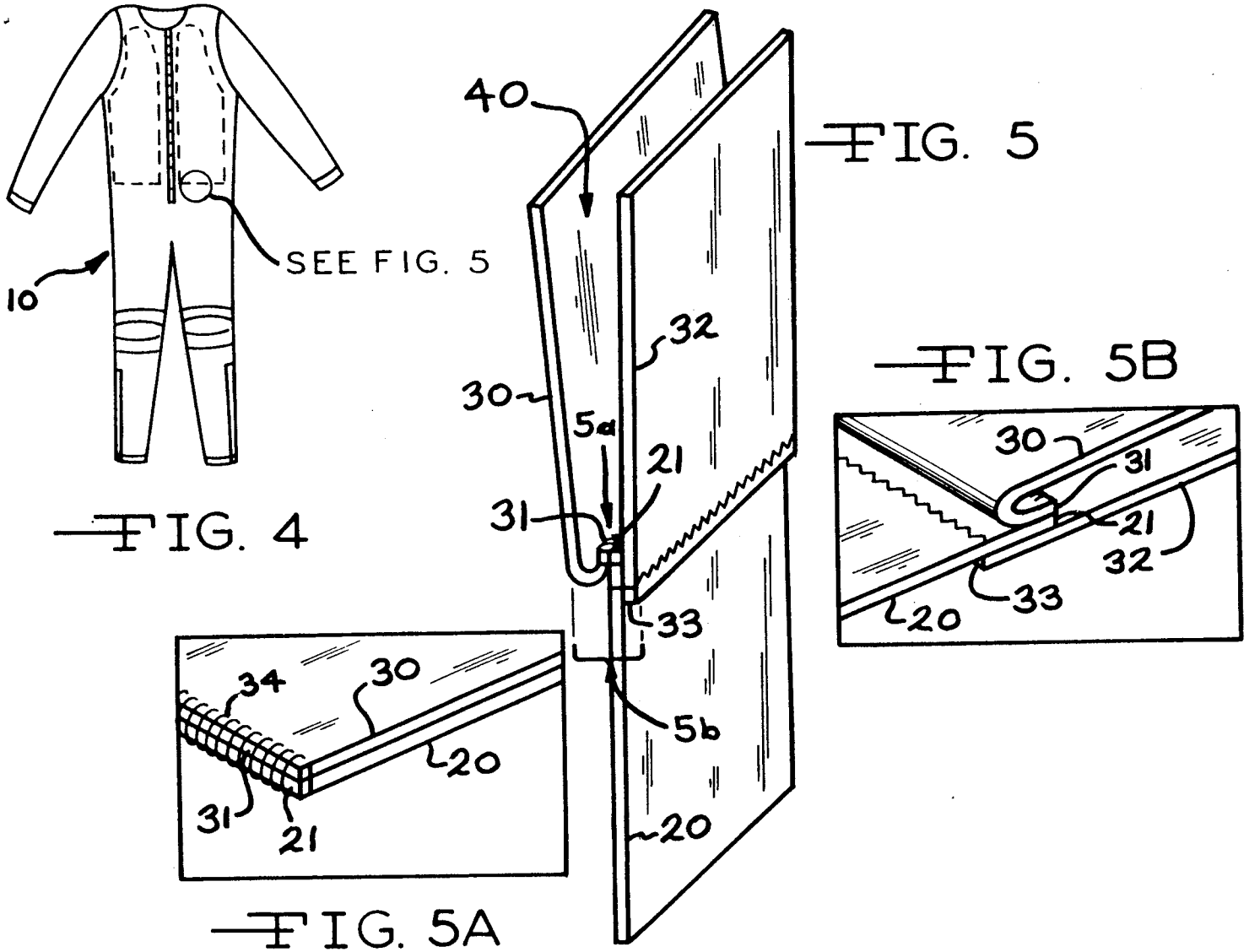
FIG. 4 is a front elevational view, partially in phantom, of an alternative embodiment of a wet suit style personal flotation device.
FIG. 5 is a fragmentary, perspective view showing an alternative embodiment of a construction of the wet suit personal flotation device.
FIG. 5A is a fragmentary, perspective view taken generally in the direction of arrow 5*a* in FIG. 5.
FIG. 5B is a fragmentary, perspective view taken generally in the direction of arrow 5*b* in FIG. 5.

Referring now to FIGS. 4 and 5 an alternative construction of the wet suit style personal flotation device 10 of the present invention is shown. The wet suit style personal flotation device 10 can be constructed as follows: the leading edge 31 of the outer layer 30 of the vest 16 is aligned with the leading edge 21 of the pants 20 and sewn together with serge stitches 34 as shown in FIG. 5A. Thereafter, the leading edge 33 of the inner layer 32 is placed in a spaced apart relationship to the sewn together leading edges 21 and 31, and the inner layer 32 of the vest 16 is sewn to the pants 20 as can be seen by referring to FIG. 5B with the zigzag type stitch 36.

Figures 6, 7, 7A, 7B:
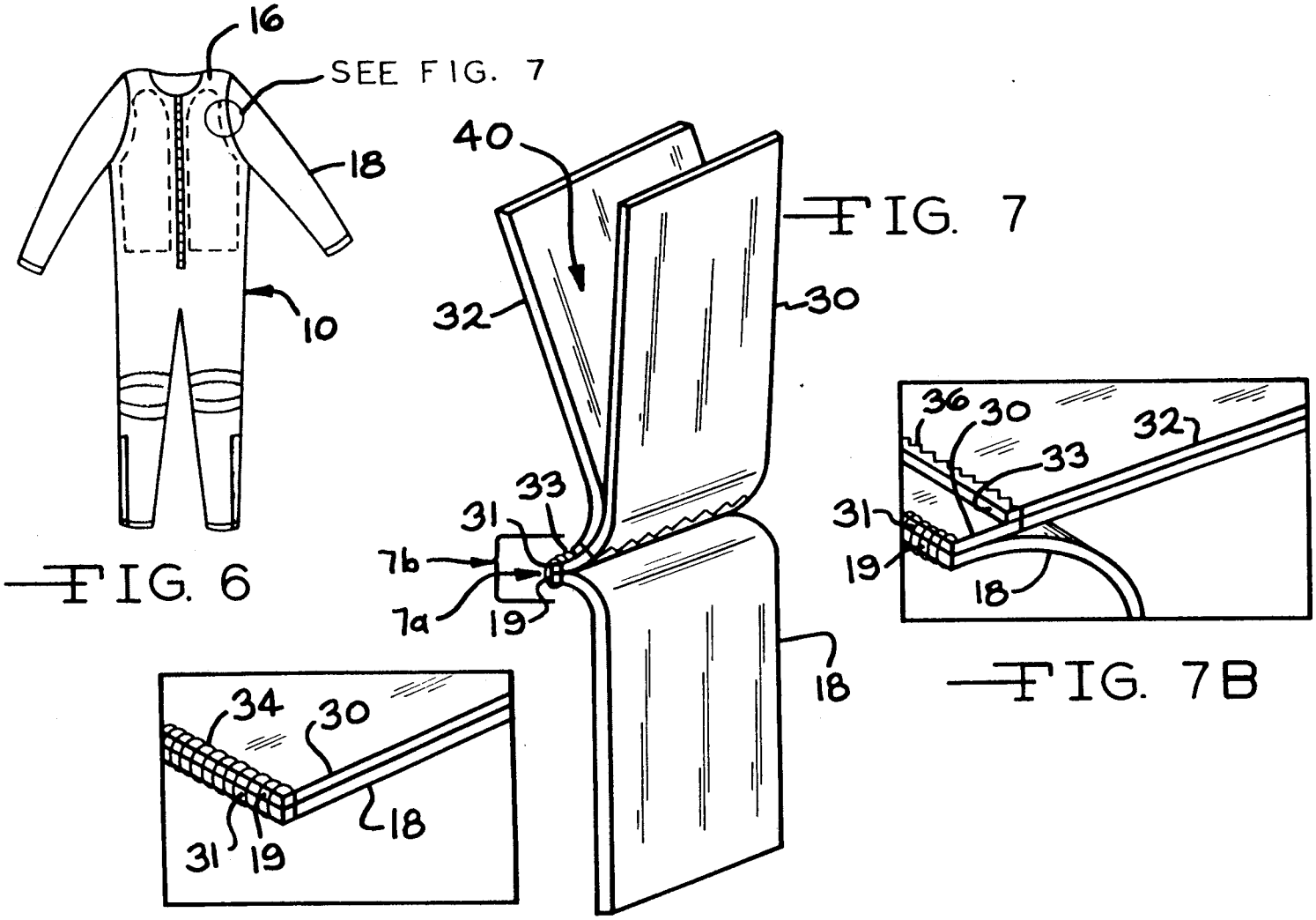
FIG. 6 is a front elevational view, partially in phantom, of a wet suit style personal flotation device.
FIG. 7 is a fragmentary, perspective view showing an embodiment of a construction of the wet suit style personal flotation device.
FIG. 7A is a fragmentary, perspective view taken generally in the direction of arrow 7*a* in FIG. 7.
FIG. 7B is a fragmentary, perspective view taken generally in the direction of arrow 7*b* in FIG. 7.

Referring now to FIGS. 6 and 7, the attachment of the sleeve 18 to the vest 16 is generally shown. The leading edge 31 of the outer layer 30 is placed in alignment with a leading edge 19 of the sleeve 18 and sewn together with a serge type stitch 34 as shown in FIG. 7A. The leading edge 33 of the inner layer 32 of the vest 16 is aligned with the sewn together outer layer 30 and sleeve 18 such that the leading edge 33 is in a spaced apart relationship to the leading edge 31 of the outer layer 30 and the leading edge 19 of the sleeve 18. In this position, the outer layer 30 and inner layer 32 are sewn together with a zigzag type stitch 36 as shown in FIG. 7B.

Figure 9:
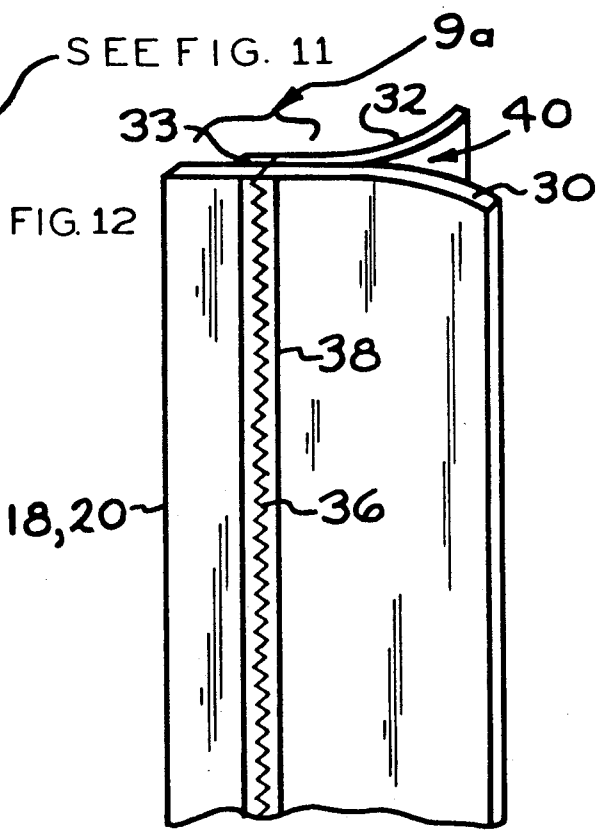
FIG. 9 is a fragmentary, perspective view showing an embodiment of a construction of the wet suit style personal flotation device.
Figure 8:
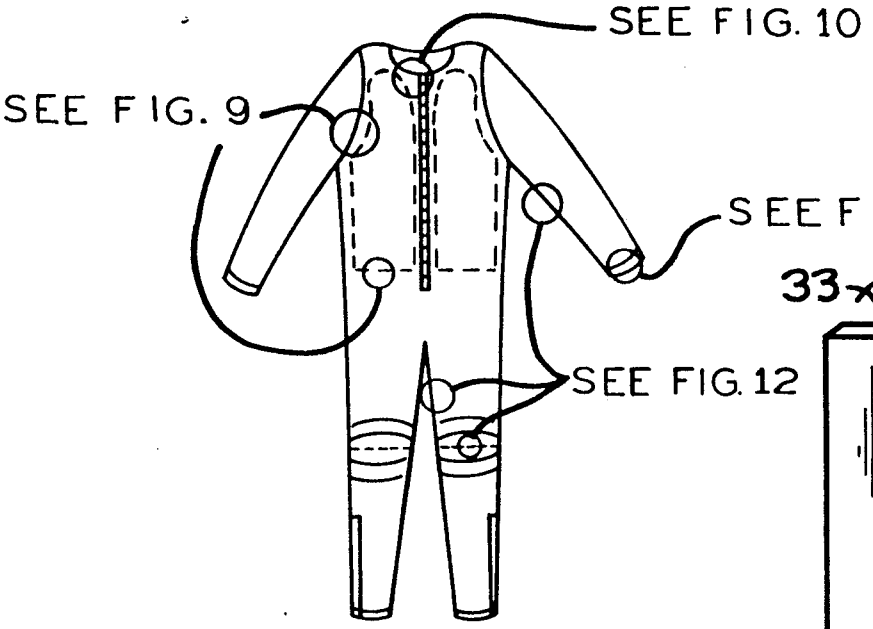
FIG. 8 is a front elevational view, partially in phantom, of a wet suit style personal flotation device.

Referring now to FIGS. 8 and 9, yet another embodiment of construction of the wet suit style personal flotation device 10 of the present invention is generally shown. As seen in FIG. 9, the outer layer 30 of the vest 16 is integral with the sleeve 18 and/or pants 20. The leading edge 33 of the inner layer 31 is aligned at a point where the sleeve 18 and/or pants 20 of the suit 14 generally begins. Thereafter, the inner layer 32 is sewn to the integral sleeve 18 and/or pants 20—outer layer 30 using, for example, a Mauser tape 38 and the zigzag stitch 36.

Thus, it is also within the contemplated scope of the present invention that the wet suit style personal flotation device 10 comprise a suit 14 having the outer layer of the vest 16 and sleeves 18 and/or pants 20 formed from an integral piece of the flexible protective neoprene material (not shown). In such an embodiment an inner layer of the vest (not shown) are seamed to the inside of the outer layer of the vest 16 at points where pockets (not shown) are desired. Thereafter, the inserts 12 are placed in the pockets (not shown) and the pockets (not shown) are seamed together to the suit 14 such that the inserts 12 are held within the pockets.

Figure 10A:
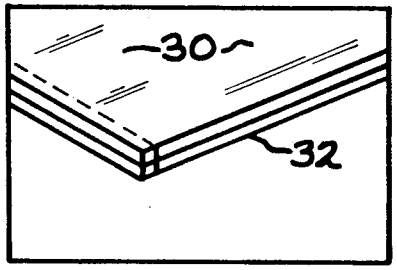
FIG. 10A is a fragmentary, perspective view taken generally in the direction of arrow 10*a* in FIG. 10.
Figure 10:
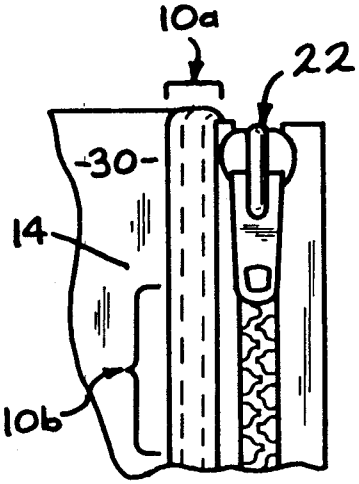
FIG. 10 is a fragmentary view showing an embodiment of a construction of the wet suit style personal flotation device.
Figure 10B:
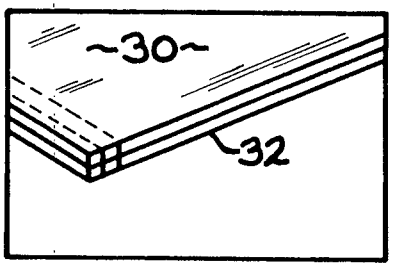
FIG. 10B is a fragmentary, perspective view taken generally in the direction of arrow 10*b* in FIG. 10.

Referring now to FIG. 10, one embodiment of a construction of the fastening mechanism 22, herein shown as a zipper to the suit 14 is shown. The installation of the fastening mechanism 22 is generally shown wherein a straight stitch using about 7 +/−1 stitches per inch can be used and where a double needle and/or chain stitch using about 8 +/−1 stitches per inch can generally be shown in a manner which is conventional in the art of installing such fastening mechanisms. FIGS. 10A and 10B generally show the stitching which can be used in the installation of the fastening mechanism 22 in the wet suit style personal flotation device of the present invention.

Figure 11:
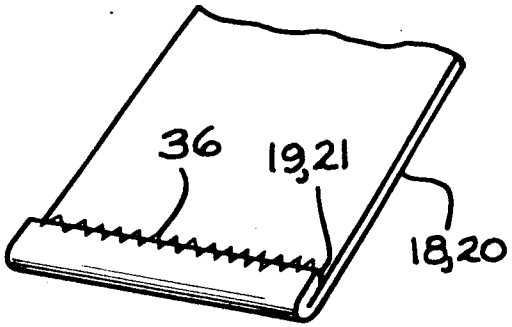
FIG. 11 is a fragmentary, perspective view showing an embodiment of a construction of the wet suit style personal flotation device.
Figure 12A:
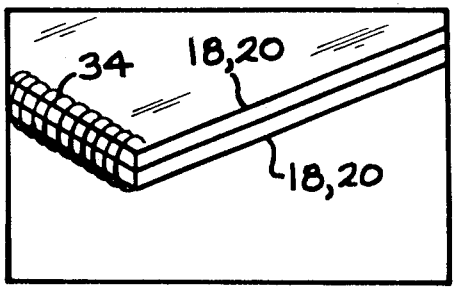
FIG. 12A is a fragmentary, perspective view taken generally in the direction of arrow 12*a* in FIG. 12.
Figure 12:
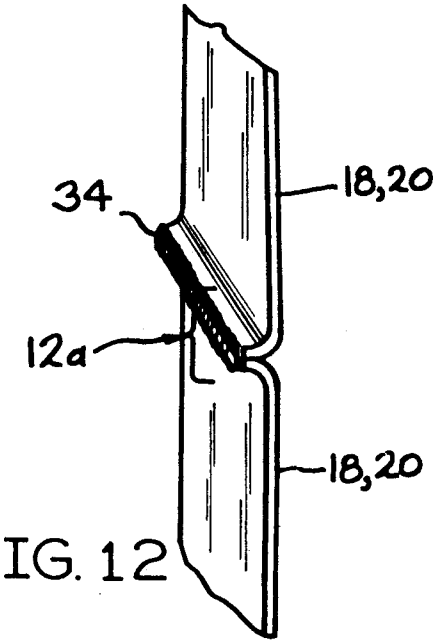
FIG. 12 is a fragmentary, perspective view showing an embodiment of a construction of the wet suit style personal flotation device.

Referring now to FIG. 11, the finishing of the sleeve 18 and pants 20 are generally shown. The leading edge 19 of the sleeve 18 adjacent the wrist of the wearer and the leading edge 21 of the pants 20 adjacent the ankle of the wearer are doubled back onto themselves and seamed together with, for example, a zigzag type stitch 36 to form a rounded finishing edge. FIG. 12 shows various other seams of the wet suit style personal flotation device 10 wherein portions of the pants 20, either at the knee or inseam, or along the sleeve 18, for example, are seamed by placing leading edges of the various portions adjacent each other and then sewing together with, for example, a serge type stitch 34 as shown in FIG. 7A.

Figure 13:
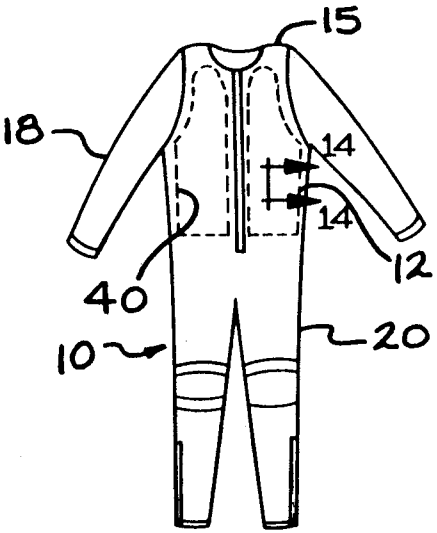
FIG. 13 is a front elevational view, partly in phantom, of a wet suit style personal flotation device.
Figure 14:
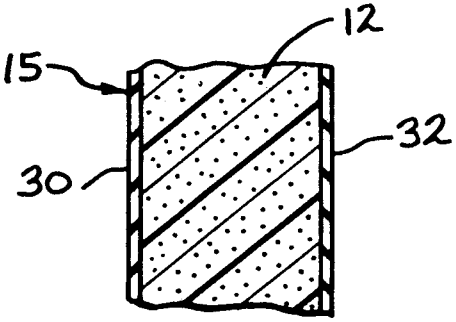
FIG. 14 is a cross-sectional view taken along the lines 14—14 in FIG. 13.

Referring now to FIG. 13, a front elevational view of the wet suit style personal flotation device 10 of the present invention is generally shown. FIG. 14 is a cross-sectional view generally showing the foam buoyant material of the insert 12 is snugly held in position between the outer layer 30 and the inner layer 32 of the front portion 15. In preferred embodiments, the foam buoyant material of the insert 12 for the front portion 15 ranges in width from approximately ½ of an inch to about 1¼ inches. As can be seen in FIG. 13, the inserts 12 are positioned on either side of the front portion 15 of the vest 16 within pockets 40 formed by the seaming together of the outer layer 30 and inner layer 32 of the vest 16.

Figure 15:
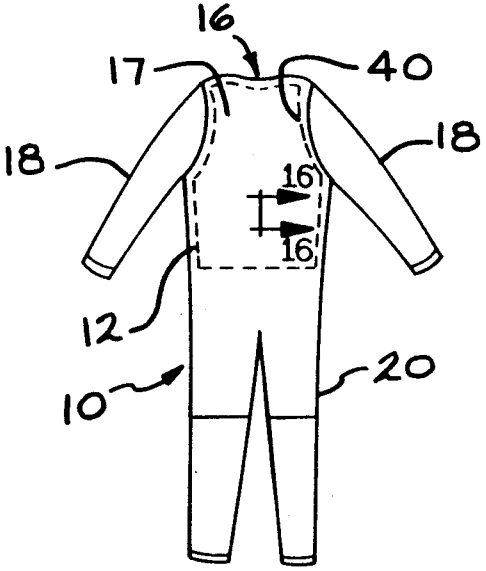
FIG. 15 is a back elevational view, partially in phantom, of a wet suit style personal flotation device.
Figure 16:
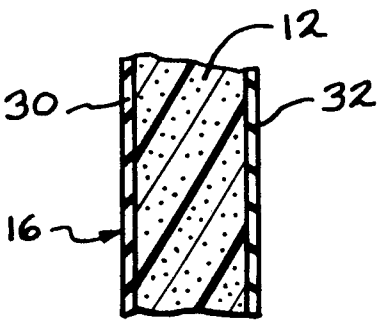
FIG. 16 is a cross-sectional view taken along the lines 16—16 in FIG. 15.

Referring now to FIG. 15 a rear elevational view of the wet suit style personal flotation device 10 is generally shown. In the embodiment shown, the foam buoyant material of the insert 12 is an integral piece generally extending along the back portion 17 of the vest 16 and is snugly held in position within the pocket 40 formed by the seaming together of the outer layer 30 and inner layer 32 of the vest 16. FIG. 16 is a cross-sectional view taken along the line 16—16 in FIG. 15 generally showing the foam buoyant material of the insert 12 positioned between the outer layer 30 and inner layer 32 of the back portion 17 of the vest 16. In preferred embodiments, the foam buoyant material of the insert 12 within the back portion 17 of the vest 16 generally ranges from about ⅜ inch to about ¾ of an inch in thickness.

It is also within the contemplated scope of the present invention that the foam buoyant material of the insert 12 be glued (not shown) into position within the pockets 40 of the vest 16 in order to aid in keeping the insert 12 held securely in position within the wet suit style personal flotation device 10 of the present invention. Any type of glue suitable for use with the foam buoyant material of the insert 12 and the flexible protective material of the suit 14 may be used.

Referring now to Table 1, various buoyancy test results of the set suit style personal flotation device 10 of the present invention are shown. The first column shows the wet suit style personal flotation device model tested along with the size for a wet suit style personal flotation device as a vest; a wet suit style personal flotation device as a vest with long or short sleeves, optionally with or without a collar; a wet suit style personal flotation device with short sleeves and a buttpad (which is padding in the rear seat of the suit); and a wet suit style personal flotation device with long legs and a buttpad. The sizes tested range from extra small to extra large. The second column shows the total buoyancy needed in order to meet U.S. Coast Guard Standards for the front and rear of the wet suit style personal flotation device in pounds and ounces and further shows the thickness of the buoyant foam material used. The total buoyancy needed was calculated such that the side seams of the vest or suit separates the front from the back. The third column shows the actual total buoyancy of the wet suit style personal flotation device of the present invention. As can be seen by referring to Table 1, the total buoyancy of the wet suit style personal flotation device of the present invention meets or exceeds the U.S. Coast Guard buoyancy requirements of at least 15½ pounds in order to be classified as a U.S. Coast Guard Type III buoyant device.

Referring to now Table 2, the buoyancy of the foam buoyant material used for the inserts 12 alone is shown. The first column shows the models and sizes tested. The second column shows the total weight of the foam buoyant material in pounds and ounces. The third and fourth columns show the buoyancy of the foam buoyant material in pounds and ounces for both the front and rear foam buoyant inserts. The last column shows the total weight of the wet suit style personal flotation device of the present invention including the flexible protective material of the suit 14 and the foam buoyant material of the inserts 12. As can be seen by comparing the buoyancy of the foam buoyant material alone to the total buoyancy of the wet suit style personal flotation device (as shown in Table 1), the flexible protective material adds to the total buoyancy of the wet suit style personal flotation device of the present invention. The buoyancy of the flexible protective material of the suit 14, along with the foam buoyant material of the insert 12 encapsulated within the pockets 40 of the vest 16, enable the wet suit style personal flotation device of the present invention to meet or exceed buoyancy standards of at least 15½ pounds set by the U.S. Coast Guard and by Underwriters Laboratory.

The present invention thus provides a wet suit style personal flotation device which ensures greater safety to the water sports enthusiast and which provides great convenience in terms of comfort and wearability. It must be understood that various modifications can be made to the present invention without departing from the scope of the invention claimed herein and in the appended claims.

TABLE 1

Buoyancy Test Results of Sample Wet Suit Style Personal Flotation Devices

| Model & Size | Needed Front Lbs.-Oz. | Foam | Rear Lbs.-Oz. | Foam | Total Front Lbs.-Oz. | Total Rear Lbs.-Oz. |
|---|---|---|---|---|---|---|
| Wet Suit Vest | | | | | | |
| XS | 9-09 | 1¼" | 6-06 | ¾" | 9-04 | 6-11 |
| S | 9-09 | 1¼" | 6-06 | ¾" | 9-07 | 6-14 |
| M | 10-08 | 1¼" | 7-00 | ¾" | 9-13½ | 7-04½ |
| L | 10-08 | 1" | 7-00 | ½" | 10-12½ | 6-05½ |
| XL | 10-08 | 1" | 7-00 | ½" | 10-13 | 6-06 |
| Wet Suit w/Long or Short Sleeve | | | | | | |
| XS | 9-09 | 1¼" | 6-06 | ¾" | 9-15½ | 7-06½ |
| S | 9-09 | 1¼" | 6-06 | ¾" | 9-13 | 7-04 |
| M (Collar) | 10-08 | 1" | 7-00 | ½" | 11-11 | 7-04 |
| L | 10-08 | 1" | 7-00 | ½" | 11-06½ | 6-15½ |
| XL | 10-08 | ¾" | 7-00 | ½" | 11-09 | 8-03 |
| Wet Suit w/Short Legs w/Buttpad | | | | | | |
| XS | 9-09 | 1¼" | 6-06 | ¾" | 10-03 | 7-10 |
| S | 9-09 | 1¼" | 6-06 | ¾" | 10-06½ | 7-13½ |
| M (Collar) | 10-08 | ¾" | 7-00 | ½" | 10-12 | 7-06 |
| L | 10-08 | ¾" | 7-00 | ½" | 11-01½ | 7-11½ |
| XL | 10-08 | ¾" | 7-00 | ½" | 11-07½ | 8-01½ |
| Wet Suit w/Long Legs w/Buttpad | | | | | | |
| XS | 9-09 | 1¼" | 6-06 | ¾" | 11-10 | 9-01 |
| S | 9-09 | 1¼" | 6-06 | ¾" | 11-15½ | 9-06½ |

TABLE 1-continued

| Buoyancy Test Results of Sample Wet Suit Style Personal Flotation Devices | | | | | | |
|---|---|---|---|---|---|---|
| | Needed Front | | | | Total | |
| Model & Size | Lbs.-Oz. | Foam | Rear Lbs.-Oz. | Foam | Front Lbs.-Oz. | Rear Lbs.-Oz. |
| M | 10-08 | ¾" | 7-00 | ½" | 12-12 | 9-06 |
| L | 10-08 | ¾" | 7-00 | ½" | 13-02½ | 9-12½ |
| XL | 10-08 | ¾" | 7-00 | ½" | 14-04 | 10-14 |

TABLE 2

| Buoyancy Of Insert (Foam) Only | | | | |
|---|---|---|---|---|
| Model & Size | Total Material Lbs.-Oz. | Front Lbs.-Oz. | Rear Lbs.-Oz. | Total Suit Lbs.-Oz. |
| Wet Suit | | | | |
| XS | 3-06 | 7-09¼ | 5-00 | 15-15 |
| S | 3-12 | 7-09 | 5-00 | 16-05 |
| M | 4-09 | 7-09 | 5-00 | 17-02 |
| L | 5-05 | 8-02 | 4-02 | 17-09 |
| XL | 5-06 | 8-02 | 4-02 | 17-10 |
| Wet Suit Vest w/Long & Short Sleeves | | | | |
| XS | 4-13 | 7-09 | 5-00 | 17-06 |
| S | 4-08 | 7-09 | 5-00 | 17-01 |
| M (Collar) | 7-02 | 8-02 | 4-02 | 19-06 |
| L | 6-09 | 8-02 | 4-02 | 18-13 |
| XL | 9-00 | 7-01 | 4-02 | 20-03 |
| Wet Suit w/Short Legs w/Buttpad | | | | |
| XS | 5-04 | 7-09 | 5-00 | 18-03 |
| S | 5-11 | 7-09 | 5-00 | 18-10 |
| M (Collar) | 7-06 | 7-01 | 4-02 | 18-09 |
| L | 8-01 | 7-01 | 4-02 | 19-04 |
| XL | 8-13 | 7-01 | 4-02 | 20-00 |
| Wet Suit w/Long Legs w/Buttpad | | | | |
| XS | 8-02 | 7-09 | 5-00 | 20-11 |
| S | 8-13 | 7-09 | 5-00 | 21-06 |
| M | 11-06 | 7-01 | 4-02 | 22-09 |
| L | 12-03 | 7-01 | 4-02 | 23-06 |
| XL | 14-06 | 7-01 | 4-02 | 25-09 |

I claim:

1. A wet suit style personal flotation device comprising:

a wet suit adapted for fitting about at least a portion of a wearer and substantially conforming to at least the wearer's torso, the wet suit comprising a pair of pants attached to a vest having an outer layer and an inner layer and at least one insert interposed between the outer layer and inner layer of the vest, the insert extending in front of and behind the wearer's body; wherein a leading edge of the outer layer of the vest and a leading edge of the inner layer of the vest are in alignment and seamed together; and the seamed together leading edges are in a spaced apart relationship to a leading edge of the pants and seamed together;

the wet suit comprising a flexible protective material and the insert comprises a foam buoyant material, the flexible protective material and the foam buoyant material having a minimum total buoyant of at least about 15½ pounds-force whereby the wet suit style personal flotation device supports the wearer in a slightly back from vertical position in water.

2. A wet suit style personal flotation device comprising:

a wet suit adapted for fitting about at least a portion of a wearer and substantially conforming to at least the wearer's torso, the wet suit comprising a pair of pants attached to a vest having an outer layer and an inner layer and at least one insert interposed between the outer layer and inner layer of the vest, the insert extending in front of and behind the wearer's body; wherein a leading edge of the outer layer of the vest and a leading edge of the pants are in alignment and seamed together; the seamed together leading edges are in a spaced apart relationship to a leading edge of the inner layer of the vest, and the leading edge of the inner layer is seamed together with a portion of the pants at a point adjacent the leading edge of the pants;

the wet suit comprising a flexible protective material and the insert comprises a foam buoyant material, the flexible protective material and the foam buoyant material having a minimum total buoyancy of at least about 15½ pounds-force whereby the wet suit style personal flotation device supports the wearer in a slightly back from vertical position in water.

3. A wet suit style personal flotation device comprising:

a wet suit adapted for fitting about at least a portion of a wearer and substantially conforming to at least the wearer's torso, the wet suit comprising sleeves attached to a vest having an outer layer and an inner layer and at least one insert interposed between the outer layer and inner layer of the vest, the insert extending in front of and behind the wearer's body; wherein a leading edge of the outer layer of the vest and a leading edge of the sleeve are in alignment and seamed together; a leading edge of the inner layer of the vest is adjacent the outer layer of the vest and in a spaced apart relationship to the seamed together leading edges, and the inner layer and outer layer of the vest are seamed together at a point adjacent the leading edge of the inner layer of the vest;

the wet suit comprising a flexible protective material and the insert comprises a foam buoyant material, the flexible protective material and the foam buoyant material having a minimum total buoyancy of at least about 15½ pound-force whereby the wet suit style personal flotation device supports the wearer in a slightly back from vertical position in water.

4. A wet suit style personal flotation device comprising:

a wet suit adapted for fitting about at least a portion of a wearer and substantially conforming to at least the wearer's torso, the wet suit comprising a pair of pants and/or sleeves attached to a vest having an outer layer and an inner layer and at least one insert interposed between the outer layer and inner layer of the vest, the insert extending in front of and behind the wearer's body; wherein the outer layer of the vest is integrally formed with the pair of pants and/or sleeves, the inner layer of the vest is adjacent the integrally formed outer layer of the vest and pants and/or sleeves, and the inner layer of the vest is seamed together to the integrally formed outer layer of the vest and pants and/or sleeves;

the wet suit comprising a flexible protective material and the insert comprises a foam buoyant material, the flexible protective material and the foam buoyant material having a minimum total buoyancy of at least about 15½-force whereby the wet suit style personal flotation device supports the wearer in a slightly back from vertical position in water.

5. The wet suit style personal flotation device of claims 1, 2, or 3, wherein the flexible protective material comprises neoprene.

6. The wet suit style personal flotation device of claims 1, 2 or 3, wherein the foam buoyant material comprises a closed-cell foamed polymeric material.

7. The wet suit style personal flotation device of claim 6, wherein the closed-cell foamed polymeric material comprises a polyvinylchloride foam material.

8. The wet suit style personal flotation device of claim 6, wherein the closed-cell foamed polymeric material comprises an ethylene-vinyl acetate foam material.

9. The wet suit style personal flotation device of claims 1, 2 or 3, wherein the wet suit includes a fastening mechanism extending along a median centerline of a front portion of the vest.

10. The wet suit style personal flotation device of claim 9, wherein the fastening mechanism is a zipper.

11. The wet suit style personal flotation device of claims 1 or 2, wherein the pants comprise two leg portions, the pants including a fastening mechanism extending along a median centerline of each leg portion.

12. The wet suit style personal flotation device of claim 11, wherein the fastening mechanism is a zipper.

* * * * *